US007458428B2

(12) United States Patent
Laudick et al.

(10) Patent No.: US 7,458,428 B2
(45) Date of Patent: Dec. 2, 2008

(54) TOWED SCRAPER BLADE CONTROL METHOD

(75) Inventors: Gregory Joseph Laudick, Cedar Falls, IA (US); Derek Malcolm Eagles, Cedar Falls, IA (US); William Guy Alexander, Waterloo, IA (US); Jeffrey David Dawson, Cedar Falls, IA (US); Thomas Eugene Boe, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 201 days.

(21) Appl. No.: 11/348,867

(22) Filed: Feb. 7, 2006

(65) Prior Publication Data

US 2007/0181318 A1 Aug. 9, 2007

(51) Int. Cl.
*A01B 79/00* (2006.01)
*E02F 3/76* (2006.01)

(52) U.S. Cl. ..... 172/1; 172/4.5

(58) Field of Classification Search ..... 172/1, 172/2, 4.5, 7, 8, 10, 11, 12, 684.5; 37/348
See application file for complete search history.

(56) References Cited

U.S. PATENT DOCUMENTS 4,031,964 A * 6/1977 Takahashi et al. ..... 172/9
4,173,258 A * 11/1979 Boulais et al. ..... 172/4.5
4,299,290 A * 11/1981 Nunes, Jr. ..... 172/4.5
5,235,511 A * 8/1993 Middleton et al. ..... 701/50
5,560,431 A * 10/1996 Stratton ..... 172/2
5,685,377 A * 11/1997 Arstein et al. ..... 172/2
6,125,561 A * 10/2000 Shull ..... 37/415
6,269,885 B1 * 8/2001 Barber et al. ..... 172/7
7,284,346 B2 * 10/2007 Miskin ..... 37/416
2006/0219417 A1 * 10/2006 Thompson et al. ..... 172/7

* cited by examiner

*Primary Examiner*—Thomas A Beach
*Assistant Examiner*—Matthew D Troutman

(57) ABSTRACT

A towed scraper control system automatically lowers the scraper blade to a working position at the start of a scraping operation according to a certain method. The method includes sensing a ground speed of the vehicle and sensing a draft force applied by the scraper to the vehicle. With the vehicle pulling the scraper at or near a target ground speed over terrain with the blade positioned above a surface of the ground, the blade is automatically lowered with respect to the scraper frame at a first rate until the blade begins to engage the surface of the ground. Thereafter, while the vehicle continues to move forward at or near the target ground speed, the blade is lowered with respect to the frame at a second rate and for a duration related to the sensed ground speed so that lowering of the blade stops when the scraper wheel begins to enter a cut produced by the blade. With the blade fixed with respect to the scraper frame, the scraper is moved forward at the target ground speed for a distance determined as a function of the sensed draft force. Thereafter, the blade is raised with respect to the frame at a rate which matches a lowering rate of the wheels as they descend along the cut, and the blade is raised at this matching rate until the position of the blade matches the position of the blade after the first lowering step. Preferably, the second rate is slower than the first rate.

8 Claims, 5 Drawing Sheets

TOWED SCRAPER BLADE CONTROL METHOD

BACKGROUND

The present invention relates to a method of controlling the blade of a towed scraper pulled by a towing vehicle, such as a tractor.

With a tractor drawn scraper the depth of cut of the scraper is manually controlled by an operator as the machine traverses the ground. To obtain maximum operating efficiency, experienced operators will feather the depth of cut to prevent clutching, tractor stall or wheel slip during use. It is often difficult for an operator to properly adjust blade position or depth at the start of a scraping operation. These tasks require an operator with considerable experience and skill and a high level of concentration to operate at an acceptable level of productivity and performance. It would be desirable to have a control system which, at the start of a towed scraper operation, can automatically, quickly and accurately move the scraper blade to its proper desired working depth.

SUMMARY

Accordingly, an object of this invention is to provide a method of automatically lowering the blade of a towed scraper to a working position.

A further object of the invention is to provide such a method which, at the start of a towed scraper operation, will quickly and accurately move the scraper blade to its proper desired working depth.

These and other objects are achieved by the present invention, wherein a control system automatically moves the blade of a towed scraper to a desired working position. The control system includes a position sensor which provides a signal proportional to the position of the scraper cutting edge relative to the scraper chassis, and a draft sensor which provides a signal proportional to the draft load exerted by the scraper on the tractor drawbar. An electronic controller receives the sensor signals, operator commands, and various signals from the tractor system. The electronic controller stores blade position setpoints, monitors the operator controls, and monitors various parameters, such as the engine rpm, transmission gear, ground speed, etc. The electronic controller moves the scraper blade to preset positions, and automatically moves the blade from a pre-dig position to a working or digging position as a scraping operation is begun under a desired method.

The method includes sensing the ground speed of the vehicle, sensing a draft force applied by the scraper to the vehicle, and with the vehicle pulling the scraper at a target measurable ground speed with the blade positioned above the surface of the ground, automatically lowering the blade with respect to the front frame at a first rate until the blade begins to engage the surface of the ground. Thereafter, while the vehicle continues to move forward at near the target ground speed, the blade is lowered at a second rate and for a duration related to the sensed ground speed so that lowering of the blade stops when the scraper wheels begin to enter the cut produced by the blade. With the blade position fixed, the scraper is moved forward at near the target ground speed for a distance determined as a function of the sensed draft force. Thereafter, the blade is raised until the position of the blade relative to the front frame matches the position of the blade relative to the front frame at the end of the first lowering step.

DETAILED DESCRIPTION

Figure 1:
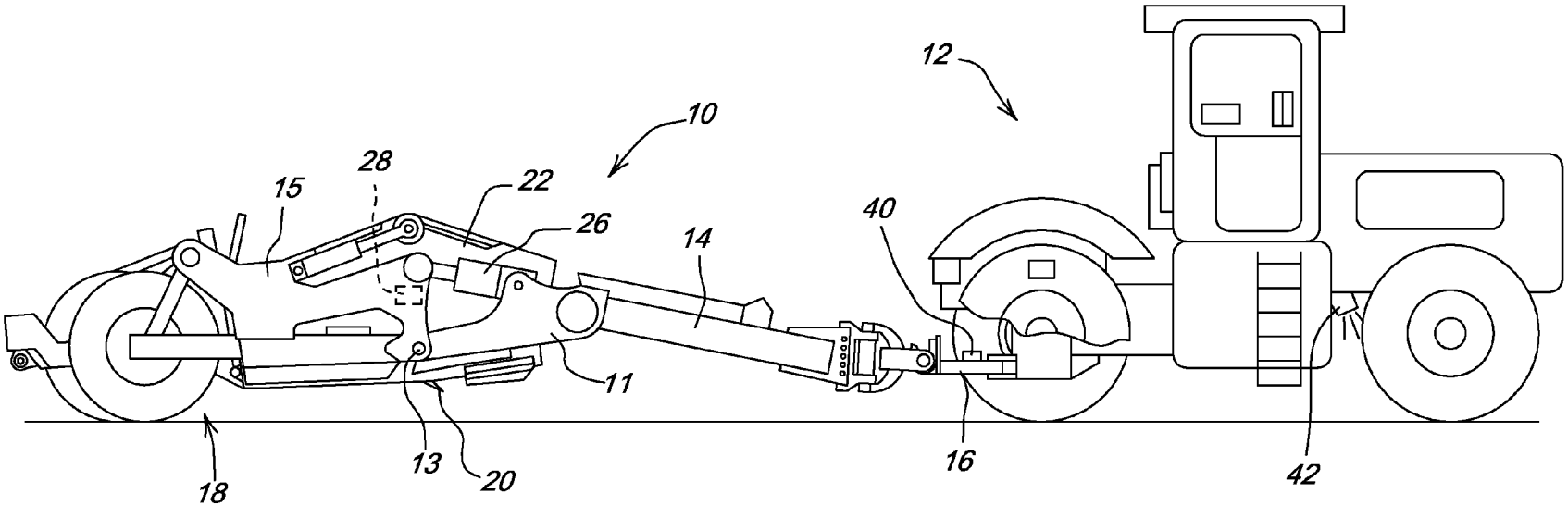
FIG. 1 is a simplified side view of a scraper pulled by a tractor.

Referring to FIG. 1, a pull-type scraper 10 is towed by a towing vehicle, such as a conventional tractor 12. The scraper 10 is preferably a conventional commercially scraper, such as a John Deere model 1810 fixed-blade ejector scraper. Such a scraper 10 includes a relatively fixed front frame 11 attached to a forward extending tongue 14 which is coupled to a drawbar 16 of the tractor 10. The scraper 10 also includes a rear frame 15 which has an aft end supported by ground engaging wheels 18 and which is pivotally coupled to the front frame 11 at pivot 13. The scraper 10 also includes a blade 20 which projects from the bottom of a gate 22 which is fixed relative to rear frame structure 15.

The gate 22 and the blade 20 are raised and lowered by blade lift cylinders 26. A blade position sensor 28 on the scraper 10 senses the position or angle of the blade 20 with respect to the front frame 11. A draft force sensor 40 is preferably mounted on a upper surface of the conventional tractor drawbar 16. The draft force sensor 40 is preferably a strain gauge type force sensor with a T-rosette configuration, similar to a Series 460 bolt-on strain gauge which is commercially available from Datum Electronics Limited. Alternatively, the draft force sensor could be mounted in an appropriate location on the scraper tongue 14.

Figure 2:
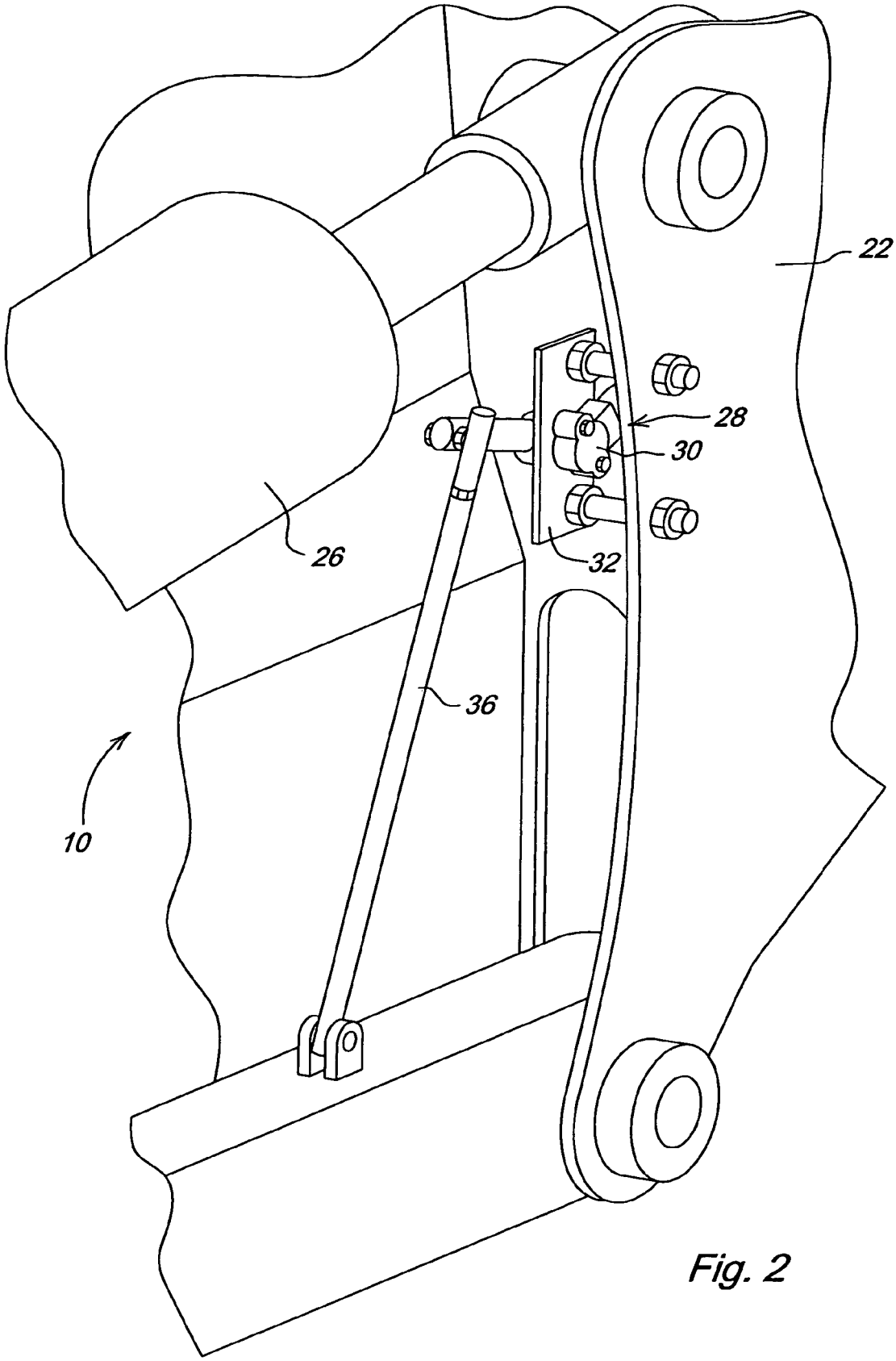
FIG. 2 is a perspective view of a blade position sensor which is mounted on the scraper of FIG. 1.

As best seen in FIG. 2, the blade position sensor unit 28 includes a rotary position sensor 30 mounted on a plate 32 which is fixed to a part of the rear frame 15. A sensing arm 34 projects from the sensor 30, and a rod 36 connects the arm to a part (not shown) of the front frame 11. As the blade 20 and gate structure 22 move with respect to the front frame 11, the rod 36 pivots arm 34 which in turn imparts a rotary input to sensor 30. The blade 20 will be raised when cylinder 26 is extended and lowered when cylinder 26 is retracted. A vehicle speed sensor 42, such as a commercially available radar speed sensing unit, is mounted on the tractor 12.

Figure 3:
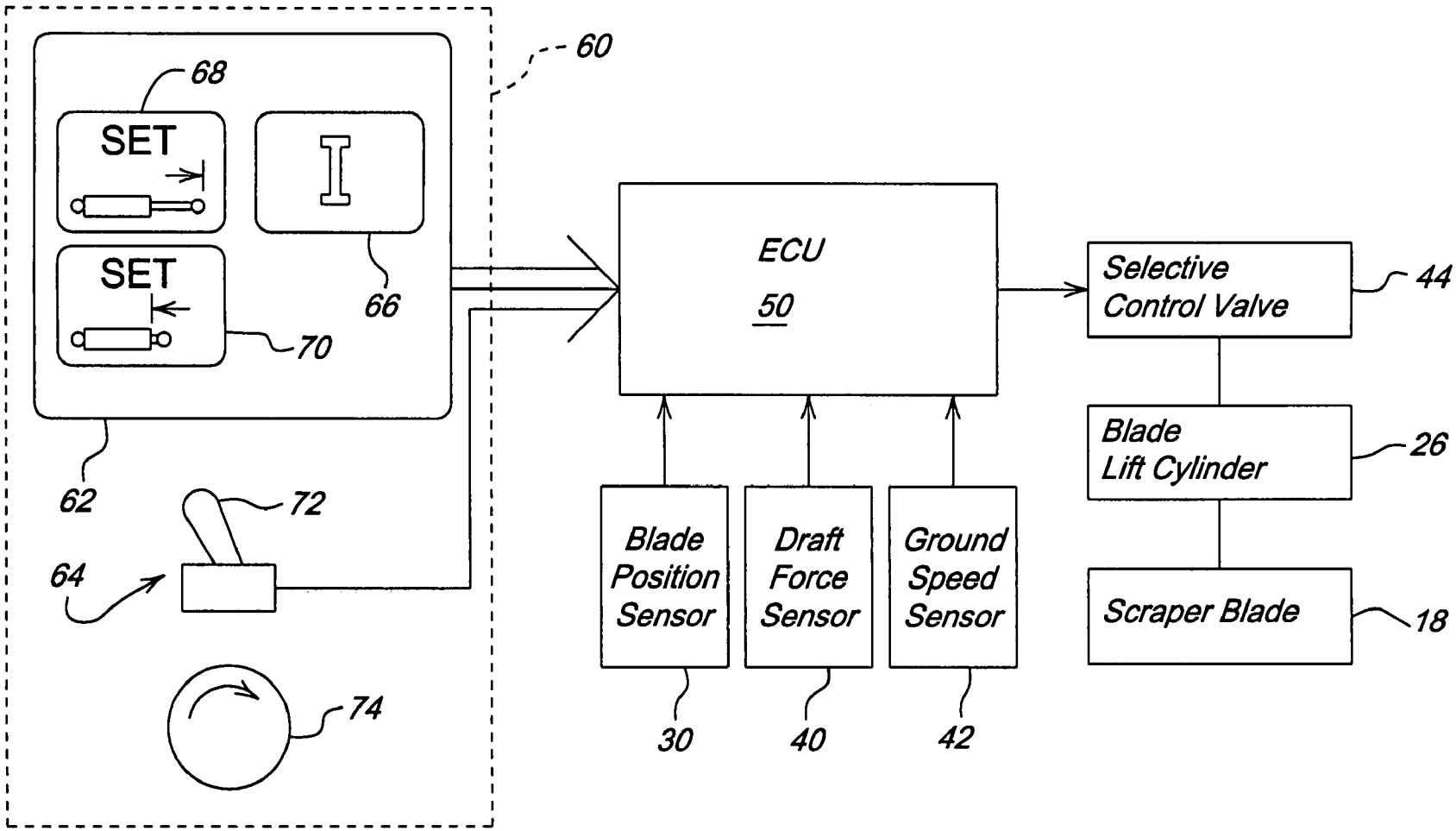
FIG. 3 is a schematic block diagram of the control system of the present invention.

Referring now to FIG. 3, a control system includes a microprocessor based electronic control unit (ECU) 50 which receives a blade position signal P from sensor 30, a draft force signal F from sensor 40 and a vehicle or ground speed signal S from sensor 42. ECU 50 also receives signals from operator controls 60 which includes a touch panel control unit 62 and a selective control valve control lever unit 64, both of which are commercially available on production John Deere tractors. The touch panel control unit 62 includes a SCV (selective control valve) select button 66, an upper set point setting button 68 and a lower set point setting button 70. The commercially available SCV control lever 64 includes a lever 72 which is movable back and forth to cause SCV I to extend (raise) and retract (lower) the lift cylinder 26, is movable to a to a detent position, and is movable fully forward to float position. The operator controls 60 also include a rotary draft force or aggressiveness setting knob 74 so the operator can set a desired operating draft force or aggressiveness value F(desired), which the ECU 50 automatically adjusts depending upon the operating gear ratio and speed to compensate for the fact that at higher gear ratios the tractor 12 is limited in the amount of draft force or pulling force it can handle. The ECU 50 provides a valve control signal VC to the SCV 44. SCV 44 is connected by hydraulic lines to the lift cylinders 26. SCV 44 controls communication between lift cylinders 26 a conventional pump (not shown) and a conventional reservoir (not shown).

Figure 4:
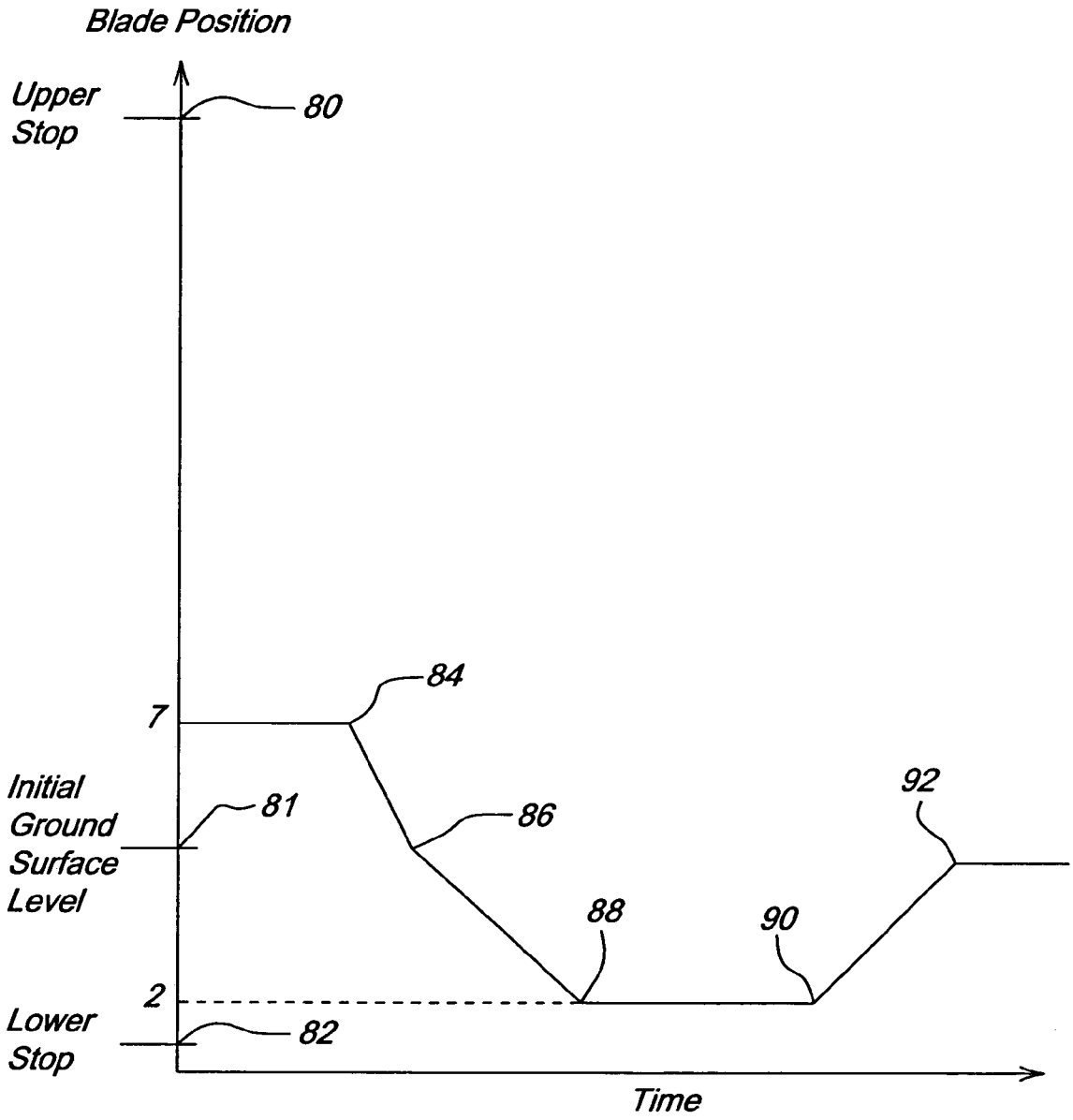
FIG. 4 is blade position versus time diagram which illustrates the blade lowering method of the present invention.
Figure 5:
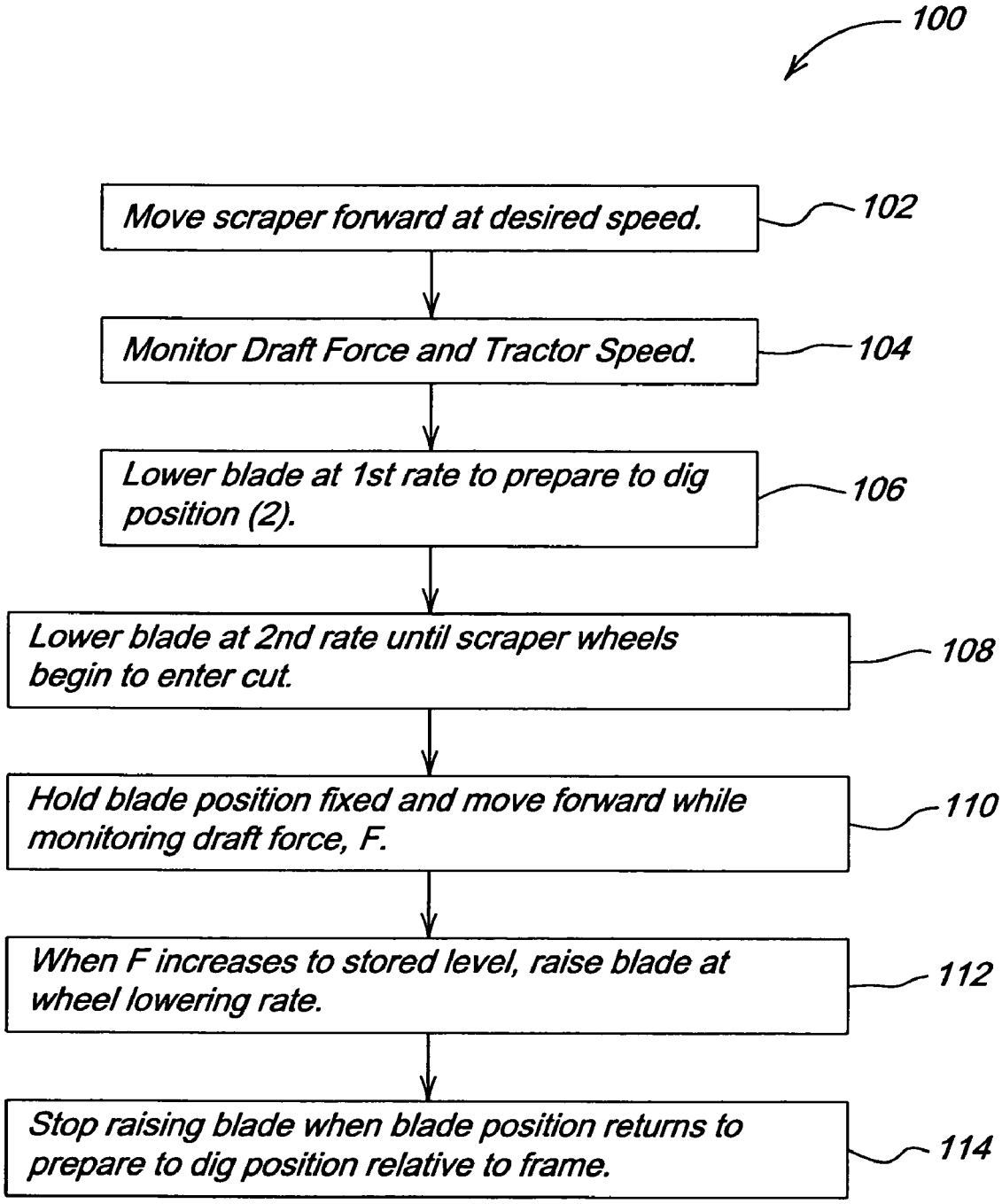
FIG. 5 is logic flow diagram illustrating the blade lowering method of the present invention.

The ECU 50 is preferably programmed to perform the automatic blade lowering method illustrated by FIGS. 4 and 5. The conversion of the above flow chart of FIG. 5 into a standard language for implementing the algorithm described by the flow chart in a digital computer or microprocessor, will be evident to one with ordinary skill in the art.

Referring to FIG. 4, the scraper blade 20 can be raised and lowered between an upper mechanical stop position 80 and a lower mechanical stop position 82, relative to the front frame 11. Line 81 represents an original ground surface level before the blade 20 has entered the ground. In a typical scraper of this type positions 80 and 82 may be as much as 28 inches apart.

Before this method is performed, the following steps are performed by an operator while the scraper 10 and tractor 12 are stationary. First, button 66 is pressed so that future inputs of the blade position signal P from sensor 30 and buttons 68 and 70 will be associated with and stored in connection with the operation of SCV 44. Then lever 72 is move back to a rearward position, thus raising the blade 20 to a desired raised position, whereupon upper set point button 68 is pressed to cause the ECU 50 to store the current signal from position sensor 30 as an upper position set point value, at or near position 80 of FIG. 4.

Lever 72 is then manipulated to cause SCV 44 to retract cylinder 26 and lower the blade 20 to a position just above and not engaging the surface of the ground, whereupon button 70 is pressed to store the current position from sensor 30 as a prepare to dig position set point value, corresponding to position 7 of FIG. 4.

Lever 72 is then manipulated to cause SCV 44 to lower the blade 20 slightly into the ground, and lever 72 is moved fully forward to its float position. Button 70 is then pressed to cause the ECU to store a working position set point value Pw 81. Lever 72 is then moved full back to the detented position and released and the ECU 50 will raise the blade to its upper set point position, at or near position 80 of FIG. 4.

Next, the tractor transmission (not shown) is placed in a working speed gear and the throttle (not shown) is moved fully forward so that the tractor 12 will move forward at the desired working speed.

Lever 72 is then pushed forward to its detent position and released. The ECU is programmed to automatically lower the blade 20 to the previously stored prepare to dig position (84 of FIG. 4). Lever 64 is then pushed forward again to its detent position and released. This start command will cause the ECU to automatically execute, according to the present invention, the method 100 of lowering the blade 20 to start a cutting operation while the scraper 10 and tractor 12 continue to move forward.

Referring to FIGS. 4 and 5, during the execution of this method, the tractor 12 pulls the scraper 10 at a selected target ground speed (step 102) over terrain with the blade 20 positioned at the preset prepare to dig position 84, and the ECU 50 monitors the tractor ground speed from sensor 42 and monitors the sensed draft force from sensor 40 (step 104). In response to a start command from the operator, the ECU 50 automatically causes cylinder 26 to lower the blade 20 at a first rate (step 106) until the blade 20 begins to engage the surface of the ground or reaches the working position 86 of FIG. 4. It should be understood that the ground speed will decrease slightly as the blade 20 engages the ground and increases the draft force applied to the tractor while the tractor engine and transmission control systems attempt to keep the tractor moving at the target ground speed.

Thereafter, while the scraper 10 continues to move forward at near the target ground speed, the blade 20 is lowered at a second rate (with respect to frame 11) and for a duration related to the sensed ground speed so that lowering of the blade 20 stops when the scraper wheel 18 begins to enter the cut produced by the blade 20 traveling through the ground (step 108). The ECU 50 determines this by integrating the ground speed to obtain the distance traveled and comparing the distance traveled to the stored distance between the blade 20 and the wheels 18. The second lowering rate is preferably slower than the first lowering rate. When the wheels 18 begin to enter the cut, lowering of the blade 20 is stopped as the scraper 10 continues to move forward, whereupon the position of the blade 20 relative to frame 11 is represented by position 88 of FIG. 4.

With the blade 20 fixed with respect to the scraper frame 11, the scraper 10 is pulled forward at the desired ground speed (step 110) while the sensed draft force is monitored and compared to a stored draft force level which is a predetermined percentage of the draft force parameter set by the operator with knob 74. The draft force will be increasing because the blade 20 will be moving downward with respect to the surface of the ground (but fixed with respect to front frame 11).

When the sensed draft force increases to this stored draft force level (position 90 of FIG. 4), the ECU 50 automatically causes the blade 20 to raise (step 112) with respect to the frame 11, preferably at a raising rate which is the same as the rate at which the wheels 18 are lowering as they descend along the cut produced by the blade 20 moving through the ground. Thus, the scraper will travel forward with the depth of blade 20 substantially fixed with respect to the ground. The ECU 50 will continue to raise the blade 20 with respect to the front frame 11 at this rate until the position of the blade 20 relative to the frame 11 reaches position 92 of FIG. 4, which will normally matches the position of the blade relative to the frame 11 represented by position 86 of FIG. 4, whereupon the ECU 50 will stop raising the blade 20 (step 114). But, because the scraper wheels 18 are down in the cut, the blade 20 will be at some working position below the surface of the ground. This working position will generate a draft force approximately equal to the stored draft force level set by the operator with knob 74.

The scraper 10 is thereafter continued to be pulled forward by the tractor 12 at the desired working speed while the position of the blade 20 remains fixed with respect to scraper frame 11. The position of the blade 20 may be thereafter controlled in a closed loop manner in response to sensed draft force, engine speed and other parameters as is well known in the implement draft control field.

A similar blade lowering method could be applicable in a tandem towed scraper arrangement (not shown) where two scrapers are towed, one behind the other. Normally, when the front scraper is filled, its blade is lifted and the rear scraper blade then-continues the same cut as its blade reaches the end of the cut made by the front scraper. In the case of the rear scraper, the lowering of its blade at the second rate would be delayed until the blade of the rear scraper engages the ramp of soil left at the point where the blade of the front scraper was lifted.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A blade lowering method for a towed scraper pulled over ground by a towing vehicle, the scraper having a front frame coupled to the towing vehicle, a rear frame, ground engaging wheels supported from the rear frame and a blade movable with respect to the front frame, the method comprising:

a) sensing the ground speed of the vehicle;

b) sensing a draft force applied by the scraper to the vehicle;

c) with the vehicle pulling the scraper at a target ground speed with the blade positioned above a surface of the ground, automatically lowering the blade with respect to the front frame at a first rate until the blade begins to engage the surface of the ground;

d) thereafter, while the vehicle continues to move forward at or near the target ground speed, lowering the blade with respect to the front frame at a second rate and for a duration related to the sensed ground speed so that lowering of the blade stops when the scraper wheels begin to enter a cut produced by the blade;

e) with the blade fixed with respect to the front frame, moving the scraper forward at or near the target ground speed for a distance determined as a function of the sensed draft force; and f) thereafter raising the blade with respect to the front frame until the position of the blade relative to the front frame matches the position of the blade relative to the front frame at the end of step c).

2. The method of claim 1, wherein:

the second rate is slower than the first rate.

3. The method of claim 1, wherein:

the blade is raised with respect to the front frame at a matching rate which matches a lowering rate of the wheels as they descend along the cut.

4. The method of claim 1, wherein:

the blade is lowered at said second rate immediately upon termination of blade lowering at said first rate.

5. A blade lowering method for a towed scraper pulled over ground by a towing vehicle, the scraper having a front frame coupled to the towing vehicle, a rear frame, ground engaging wheels supported from a rear end of the rear frame and a blade movable with respect to the front frame, the method comprising:

a) sensing the ground speed of the vehicle;

b) sensing a draft force applied by the scraper to the vehicle;

c) with the vehicle pulling the scraper at a target ground speed with the blade positioned above a surface of the ground, automatically lowering the blade with respect to the front frame at a first rate until the blade begins to engage the surface of the ground;

d) thereafter, while the vehicle continues to move forward at or near the target ground speed, lowering the blade with respect to the front frame at a second rate;

e) stopping lowering of the blade at said second rate when the scraper wheels begin to enter a cut produced by the blade;

f) while continuing to move the scraper forward at or near the target ground speed, holding the blade fixed with respect to the front frame so that the blade moves downward with respect to the ground as the scraper descends along the cut, until the sensed draft force increases to a preset draft force; and g) when the sensed draft force matches the preset draft force, raising the blade with respect to the front frame until the position of the blade relative to the front frame matches the position of the blade relative to the front frame at the end of step c).

6. The method of claim 5, wherein:

the blade is raised with respect to the front frame at a matching rate which matches a lowering rate of the wheels as they descend along the cut.

7. The method of claim 5, wherein:

the blade is lowered at said second rate immediately upon termination of blade lowering at said first rate.

8. A blade lowering method for a towed scraper pulled over ground by a towing vehicle, the scraper having a front frame coupled to the towing vehicle, a rear frame, ground engaging wheels supported from a rear end of the rear frame and a blade movable with respect to the front frame, the method comprising:

a) sensing the ground speed of the vehicle;

b) sensing a draft force applied by the scraper to the vehicle;

c) with the vehicle pulling the scraper at a target ground speed with the blade positioned above a surface of the ground, automatically lowering the blade with respect to the front frame until the blade begins to engage the surface of the ground;

d) thereafter, while the vehicle continues to move forward at or near the target ground speed, further lowering the blade with respect to the front frame;

e) when the scraper wheels begin to enter a cut produced by the blade, holding the blade fixed with respect to the front frame;

f) with the blade fixed with respect to the scraper frame, moving the scraper forward at or near the target ground speed for a distance determined as a function of the sensed draft force; and g) thereafter raising the blade with respect to the frame at a rate which matches a lowering rate of the wheels as they descend along the cut, and raising the blade at said matching rate until the position of the blade relative to the frame matches the position of the blade relative to the frame at the end of step c).

* * * * *